US006746218B2

(12) United States Patent
Heller

(10) Patent No.: US 6,746,218 B2
(45) Date of Patent: Jun. 8, 2004

(54) COMPACT ELECTROHYDRAULIC MOTOR PUMP UNIT

(75) Inventor: Roland Heller, Kornwestheim (DE)

(73) Assignee: Bosch Rexroth AG, Lohr/Main (DE)

( * ) Notice: Subject to any disclaimer, the term of this patent is extended or adjusted under 35 U.S.C. 154(b) by 1 day.

(21) Appl. No.: 10/220,163

(22) PCT Filed: Feb. 2, 2001

(86) PCT No.: PCT/EP01/01111

§ 371 (c)(1),
(2), (4) Date: Aug. 22, 2002

(87) PCT Pub. No.: WO01/65115

PCT Pub. Date: Sep. 7, 2001

(65) Prior Publication Data

US 2003/0077188 A1 Apr. 24, 2003

(30) Foreign Application Priority Data

Feb. 29, 2000 (DE) ..... 100 09 587

(51) Int. Cl.[7] ..... F04B 17/00; F04B 35/04
(52) U.S. Cl. ..... 417/423.14; 417/357
(58) Field of Search ..... 417/423.14, 366, 417/369, 423.1, 423.5, 357, 313, 415, 419, 370, 365, 360

(56) References Cited

U.S. PATENT DOCUMENTS

| | | | | |
|---|---|---|---|---|
| 3,126,030 A | | 3/1964 | Stoermer | 137/569 |
| 3,992,133 A | * | 11/1976 | Brunner | 417/366 |
| 4,648,809 A | * | 3/1987 | Gensberger | 417/366 |
| 5,173,039 A | | 12/1992 | Cook | 417/534 |
| 5,360,322 A | * | 11/1994 | Henein et al. | 417/313 |
| 5,466,131 A | * | 11/1995 | Altham et al. | 417/420 |
| 6,322,329 B1 | * | 11/2001 | Vera | 417/313 |

FOREIGN PATENT DOCUMENTS

| | | | |
|---|---|---|---|
| DE | 33 44 197 A1 | * | 6/1985 |
| DE | 3839689 | | 5/1990 |
| DE | 29609701 | | 10/1996 |
| DE | 29519941 | | 4/1997 |
| DE | 29809935 | | 11/1998 |
| DE | 299 06 881 U1 | * | 7/1999 |
| DE | 29906881 | | 12/1999 |
| EP | 0962654 | | 12/1999 |
| WO | 8400403 | | 2/1984 |

* cited by examiner

*Primary Examiner*—Justine R. Yu
*Assistant Examiner*—Han L Liu
(74) *Attorney, Agent, or Firm*—Martin A. Farber

(57) ABSTRACT

A compact electrohydraulic motor pump unit comprising a housing which forms a reservoir for a pressurized fluid and contains an electric motor, and which comprises a first housing sealing section, a second housing sealing section and a tubular housing mid-section therebetween. Disposed between the second housing sealing section and the electric motor is a support plate for a pump which can be driven by the electric motor via a motor shaft and by which pressurized fluid can be conveyed on a pressurized flow path to a delivery connection. In such a conventional type motor pump unit, a circumferential seal, which is intended to seal off the interior of the housing, is located both between the support plate and the housing mid-section and between the support plate and the second housing sealing section. In order to reduce the number of sealing points between the interior and the exterior of the housing, the delivery connection is located externally on the second housing sealing section, and the second housing sealing section and the tubular housing mid-section, sealing off the interior of the housing from the outside, rest against one another peripherally and the support plate is located entirely within the housing.

17 Claims, 8 Drawing Sheets

COMPACT ELECTROHYDRAULIC MOTOR PUMP UNIT

FIELD AND BACKGROUND OF THE INVENTION

The invention relates to a compact electrohydraulic motor pump unit.

Such a motor pump unit has been disclosed by DE 299 06 881 U1. This unit possesses a housing which forms a reservoir for a pressurized fluid and in which an electric motor is located. A housing mid-section is of tubular form and closed off at one end face by a first housing lid or, in more general terms, by a first housing sealing section. In front of the other end face of the housing mid-section is located a second housing sealing section which, in the conventional motor pump unit, does not however lie directly on the housing mid-section. Between the second housing sealing section and the housing mid-section, instead, is located a support plate on which a radial piston pump, drivable via the motor shaft of the electric motor, and a similarly drivable gear pump are fixed. Located in the support plate are ducts via which pressurized fluid can be conveyed by the pumps to two delivery connections externally on the support plate.

In the conventional motor pump unit, the interior of the housing has to be sealed off peripherally from the outside between the housing mid-section and the first housing sealing section, between the housing mid-section and the support plate and between the support plate and the second housing sealing section. This is disadvantageous, as the risk of a leakage increases with the number of sealing points and with the length of the seals. Today, however, great importance is attached to clean production areas and the protection of the environment.

SUMMARY OF THE INVENTION

It is therefore an object of the present invention further to develop such a compact electrohydraulic motor pump unit such that the number of sealing points between individual housing sections is reduced.

This object is achieved, according to the invention, in that, in a compact electrohydraulic motor pump unit of the introductory-mentioned type, the delivery connection is located externally on the second housing sealing section, in that the second housing sealing section and the tubular housing mid-section, sealing the interior of the housing from the outside, rest on one another peripherally, and in that the support plate is located entirely within the housing. In a motor pump unit according to the invention, therefore, the support plate has lost its function as a housing section by comparison with the motor pump unit in accordance with the above-mentioned state of the art. The second housing sealing section lies, like the first housing sealing section, directly on the housing mid-section, so that there are now only two peripheral sealing points of large diameter. The risk of a leakage to the exterior is significantly reduced thereby.

Advantageous embodiments of a compact electrohydraulic motor pump unit according to the invention are provided.

In an effort to keep down the installation effort required for a motor pump unit according to the invention, a tube is provided which lies in the pressurized flow path from the pump to a delivery connection on the second housing sealing section and is connected axially by a plug-in fitting to the second housing sealing section at one end and connected axially by a plug-in fitting to a counterpart at the other end. This permits particularly simple assembly in the axial direction of the motor shaft of the electric motor. In this case, in principle, axial plugging-in of the tube is also possible if although the ends of the tube point in the axial direction they are not aligned with one another and the tube is bent. Preferably, however, the tube is straight and extends axially. Special working steps for bending the tube are thereby avoided. Preferably, the tube is plugged into a bore at each of its ends. The diameter of the tube may then be smaller than in a case where the ends are fitted onto pegs.

The tube lies in the pressurized flow path of the pressurized fluid, in which pressure pulses occur, as a result of which the tube might perform small axial movements because of the dimensional tolerances arising in the dimensions of the components and on the tube itself. In order to prevent this, and wear associated therewith and the evolution of noise attributable thereto, the invention provides that the tube is pressed against the other section in one axial direction by a spring element, which is tensioned between the tube and one section of the two sections comprising the counterpart and the second housing sealing section. The spring element is advantageously tensioned between an external shoulder of the tube and the counterpart or the second housing sealing section. It is particularly economical of space and cost-effective for the spring element to be formed by an O-ring. In order to obtain a sufficiently large supporting surface for the spring element even when the tube wall thickness is slight, the invention provides for the insertion of a shim between the spring element and the tube.

Compact electrohydraulic motor pump units of substantially the same construction customarily form a complete series with different structural sizes and different specifications. In order to be able to use the same tube with as many versions as possible, the invention provides that a length-compensation disk is threaded onto the turned-down end of a tube. Preferably, the length-compensation disk lies between the O-ring and the external shoulder of the tube, so that it is retained on the tube before and during assembly of the tube by the O-ring, which is pushed onto the tube with tension.

Depending upon the side of the support plate on which a pump is disposed, and depending on what kind of pump is involved, a tube extends, between the support plate and the second housing sealing section, or, between a connecting flange of the pump and the second housing sealing section. The latter will be the case, for example, if a gear pump or vane-cell pump is disposed on the side of the support plate remote from the electric motor and comprises a radially descending delivery outlet. The former will be the case, primarily, if the pump is seated on the side of the support plate facing toward the electric motor.

It is be desirable to be able to use compact electrohydraulic motor pump units flexibly, with one pump or with two pumps which can convey in different hydraulic circuits, and adjusted to the spatial conditions at a machine tool for which such units are primarily used. Therefore, the second housing sealing section is provided with two delivery connections and two plug-in connections for a tube. If two pumps are driven by the electric motor, one can pump to one delivery connection and the other to the other delivery connection. In this case, the form of the pressurized flow paths is such that either one pump or, only because of different installation, the other pump pumps to one delivery connection. Similarly, the sections may be so assembled that, where only one pump is present, either one delivery connection or the other delivery connection is used. In particular, the support plate has two plug-in connections for a tube, a tube extending between one plug-in connection of the support plate and one plug-in connection of the second housing sealing section and other plug-in connection of the support plate being closed off. In this case, therefore, a pump in whose pressurized flow path ducts also lie within the support plate can pump, by selection of the appropriate plug-in connection on the support plate, to one delivery connection or to the other. Installation of the support plate in different angular attitudes relative to the axis of the motor shaft would, admittedly, permit pumping to one delivery connection or to the other delivery connection even with only one plug-in connection in the support plate and two plug-in connections in the second housing sealing section. In that case, however, the two plug-in connections in the housing sealing section would have to be located at the same distance from the axis of the motor shaft. This again is not in all cases compatible with the arrangement of the plug-in connections in the second housing sealing section that is necessary for the use of two pumps.

Special embodiments with two pumps are also provided by the invention.

BRIEF DESCRIPTION OF THE DRAWINGS

In the embodiment shown in FIGS. 1 to 4 a plurality of conveying units 41 of a radial piston pump 40 are fixed on the side of the support plate 35 facing toward the electric motor 11. Specifically, the conveying units are axially located between the support plate 35 and an annular disk 42, which is fixedly connected to the support plate 35 via screws 43 passing laterally by the conveying units 41 and guiding the conveying units laterally. The conveying units aspirate pressurized liquid from the interior of the housing 10 and release it via pressure valves 44 into a ducting system of the support plate 35 which lies in a flow path to one of two connecting sockets 45 on the cover 13. It is apparent from figure 4 that the two connecting sockets 45 are disposed at an angular distance of 90° apart on the cover 13. The pressure valves 44 substantially consist of, in each case, a spherical closing body, a closing spring and a cylindrical housing which plugs at one end into the support plate 35 and at the other end into the cylinder of a conveying unit 41 and thus helps to mount the conveying units 41. The pistons 47 of the conveying units 41 are pressed by a spring 48 against a cam 49 of a camshaft 50, which is inserted into the motor shaft 23 and is rotatably mounted in a ballbearing 51 received by the support plate 35.

When a drive is provided by the electric motor 11, in the example of embodiment shown in FIGS. 1 and 2, the conveying units 41 of the radial piston pump convey pressure medium via the pressure valves 44, the ducting system in the support plate 35, the tube 60 and a duct formed by one or more bores in the cover 13 to a connecting cap 45, which may be referred to as the first connecting cap. The gear pump 65 pumps via the connecting flange 66, the tube 68 and a duct in the cover 13 to the second connecting cap 45. With the compact unit, therefore, hydraulic consumers lying in two separate hydraulic circuits can be supplied with pressure medium. It may sometimes be desirable here, with the same arrangement of the unit on a machine, for the radial piston pump to pump to the second connecting cap and the gear pump to the first connecting cap. In order for it to be possible to provide the kind of alternative embodiment shown in FIG. 3 in an easy manner, simply by means of a different assembly of the parts, the second insertion bore 52 is present in the support plate 35. The insertion bore 52 closed off by the screw 55 in the embodiment shown in FIGS. 1 and 2 is in fact precisely aligned with the second insertion bore 61 of the cover 13. The long tube 60 can thus readily be plugged into the second insertion bore of the support plate 35 and the second insertion bore 61 of the cover 13. In that case, the other insertion bore 52 of the support plate 35 is closed off by a screw 55. For the flow path between the gear pump 65 and the other connecting cap on the cover 13, a connecting flange 66 is used in which the insertion bore 67 lies on the other side from the delivery connection of the gear pump 65, as is clearly apparent from FIG. 3. Apart from the two different connecting flanges 66, therefore, no different parts are necessary in order to produce the two alternative embodiments, either that according to FIGS. 1 and 2 or that according to FIG. 3.

Figure 1:
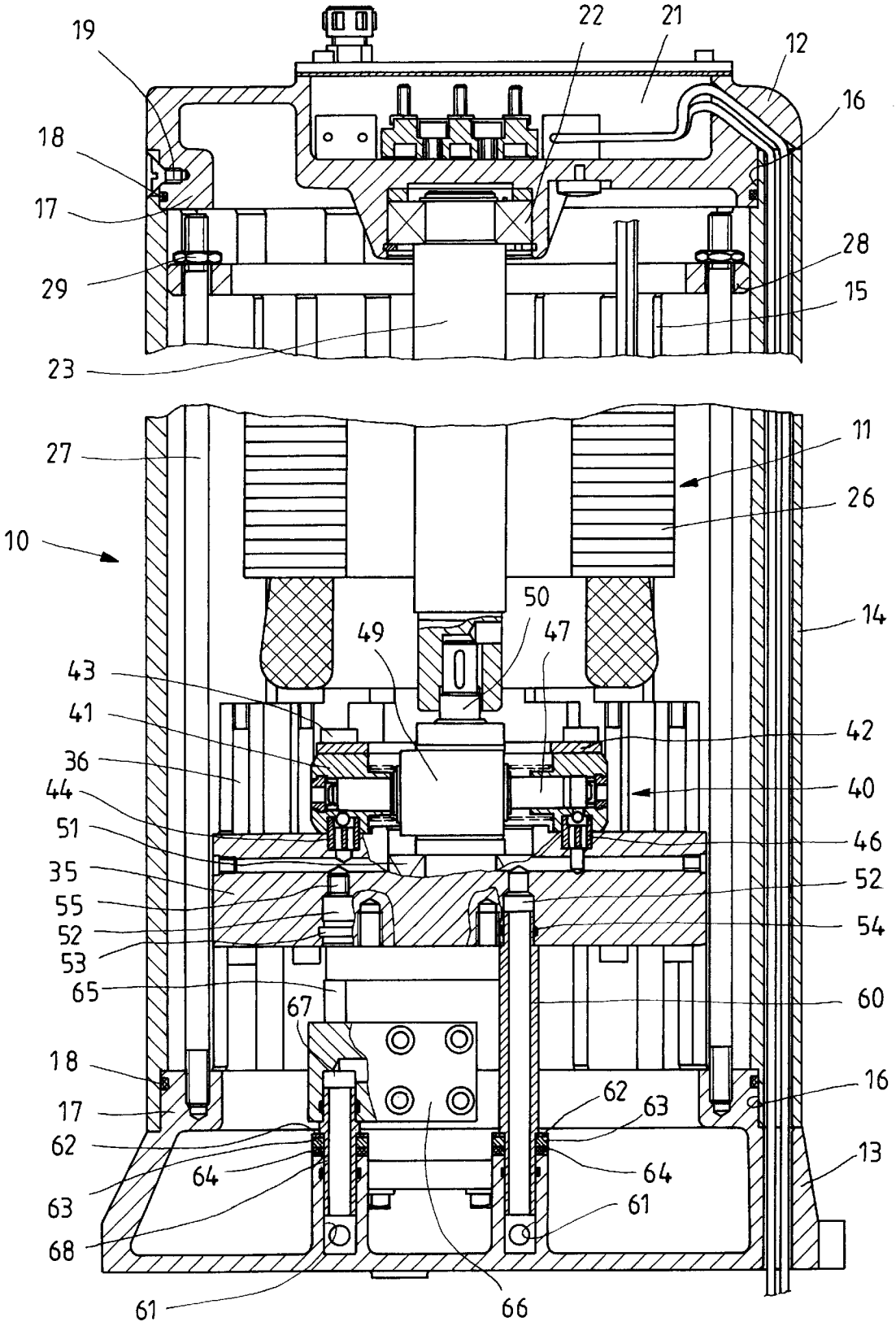

A plurality of examples of embodiment of a compact electrohydraulic motor pump unit according to the invention are shown in the drawings. The invention will now be explained in detail with reference to the figures of those drawings.

Figure 2:
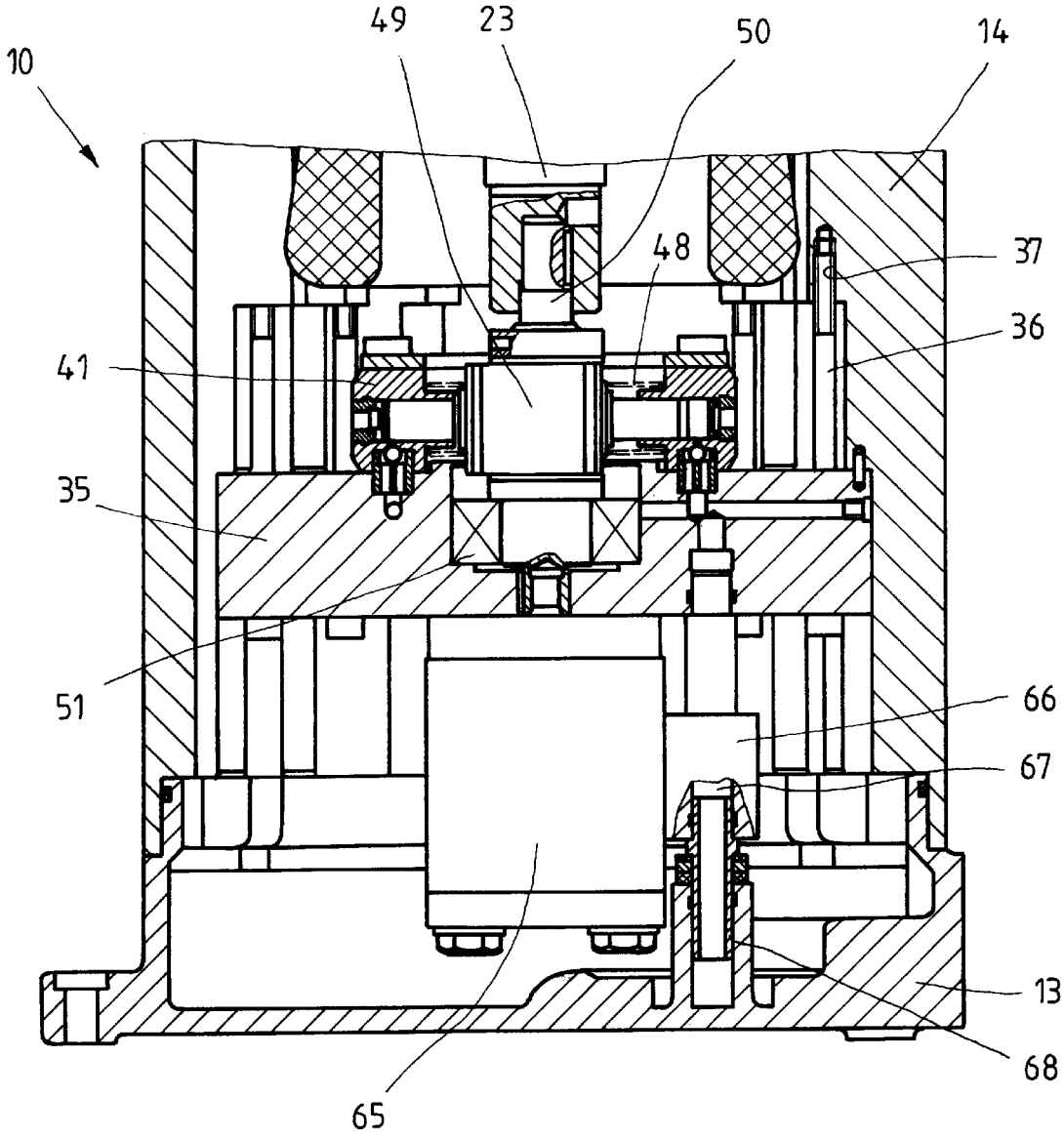
Figure 3:
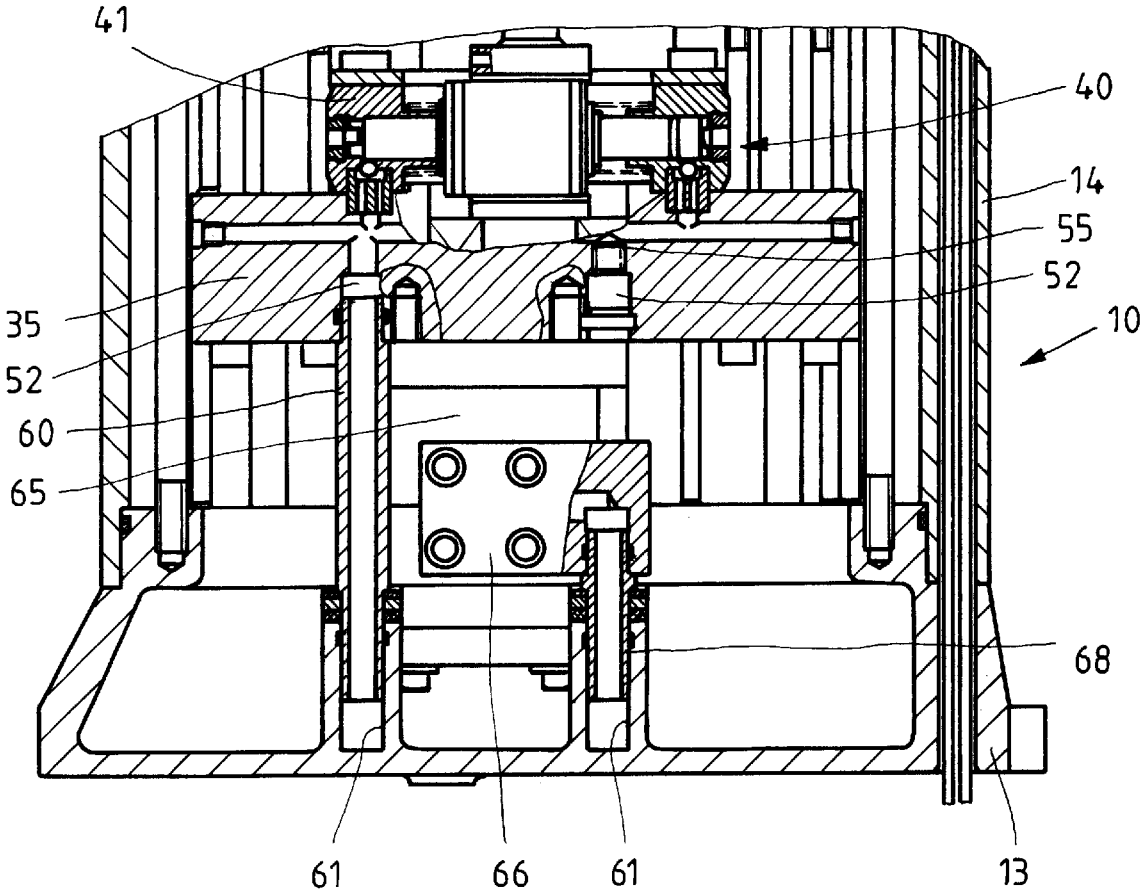
Figure 4:
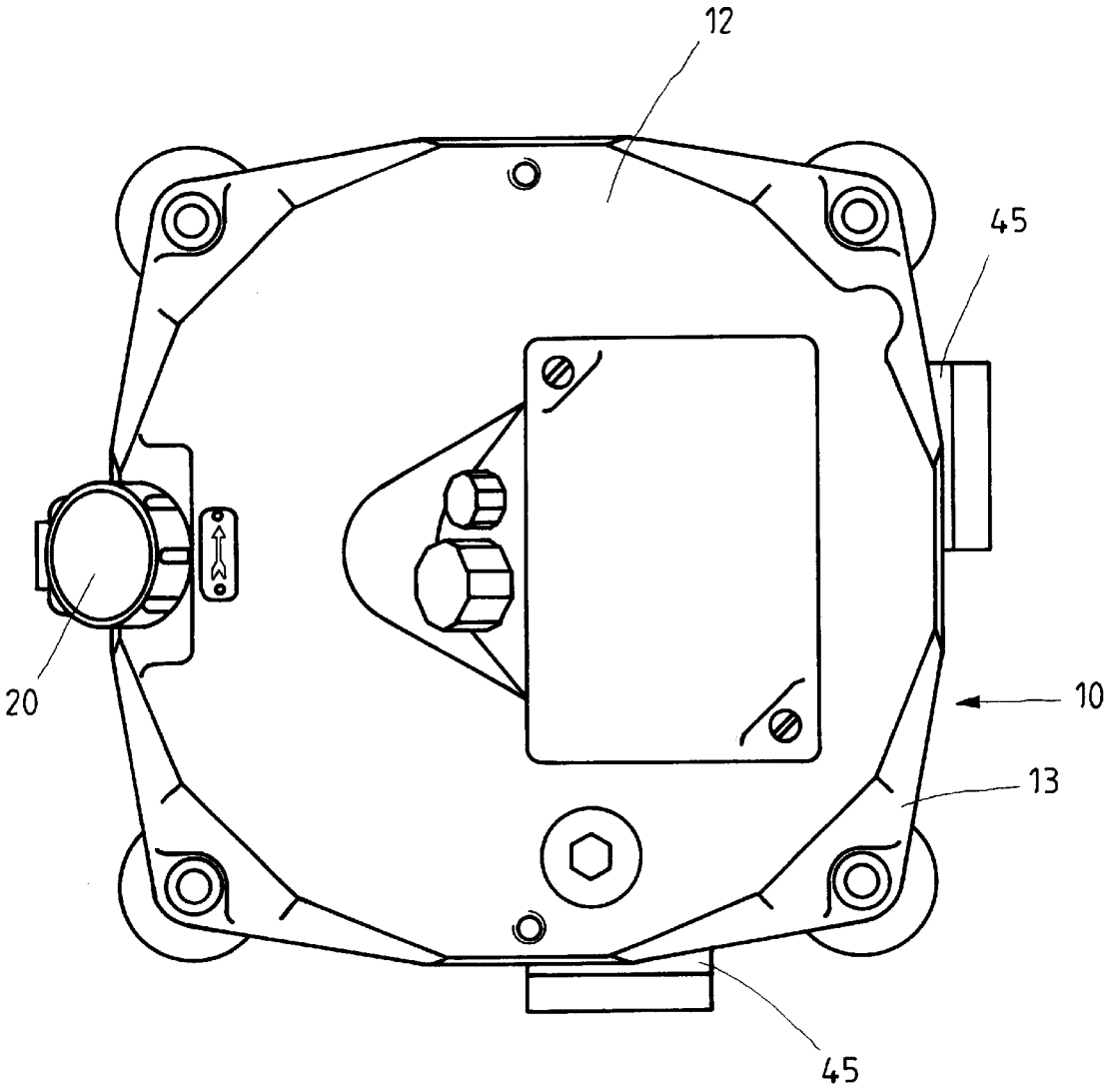
Figure 5:
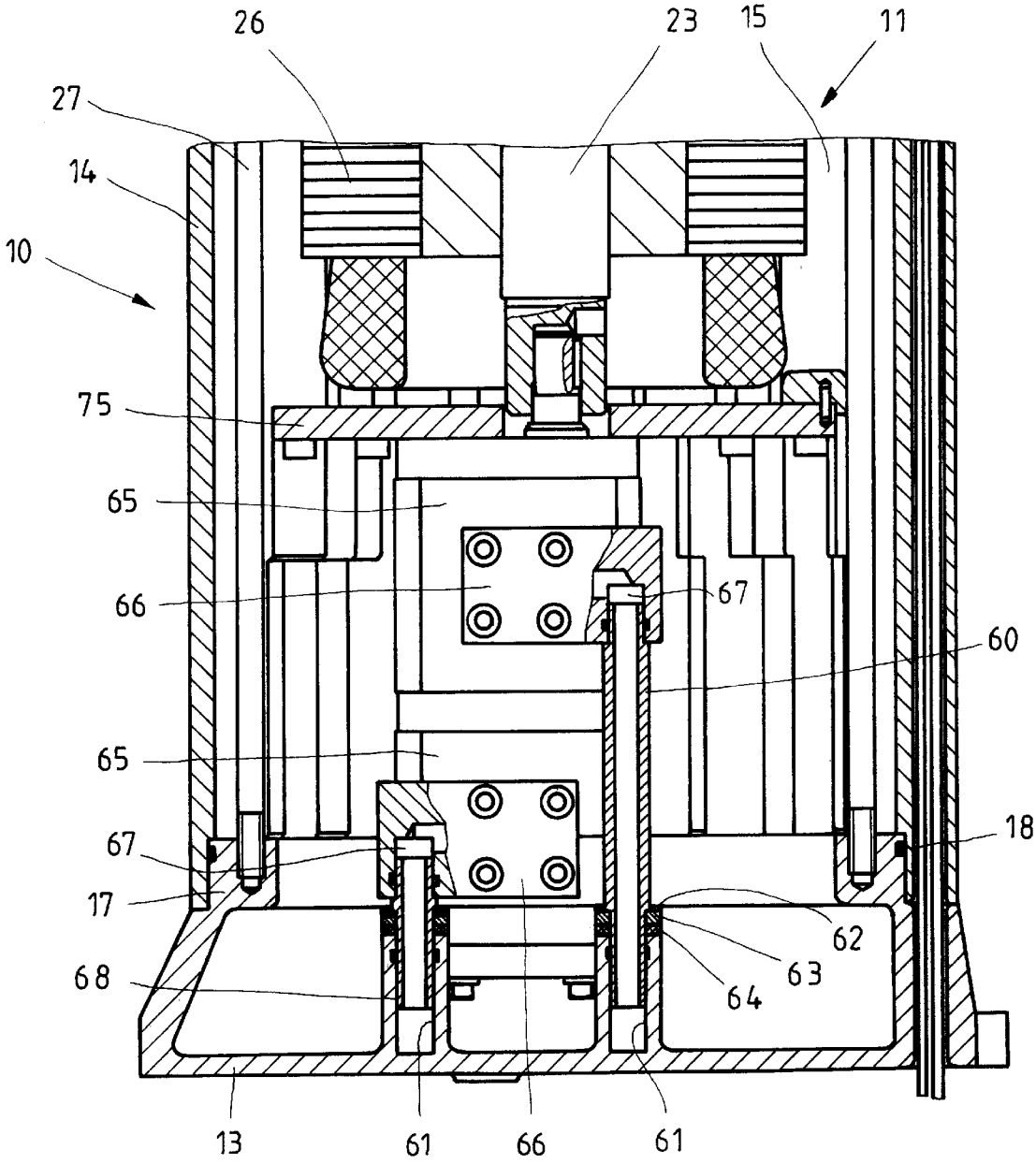
Figure 6:
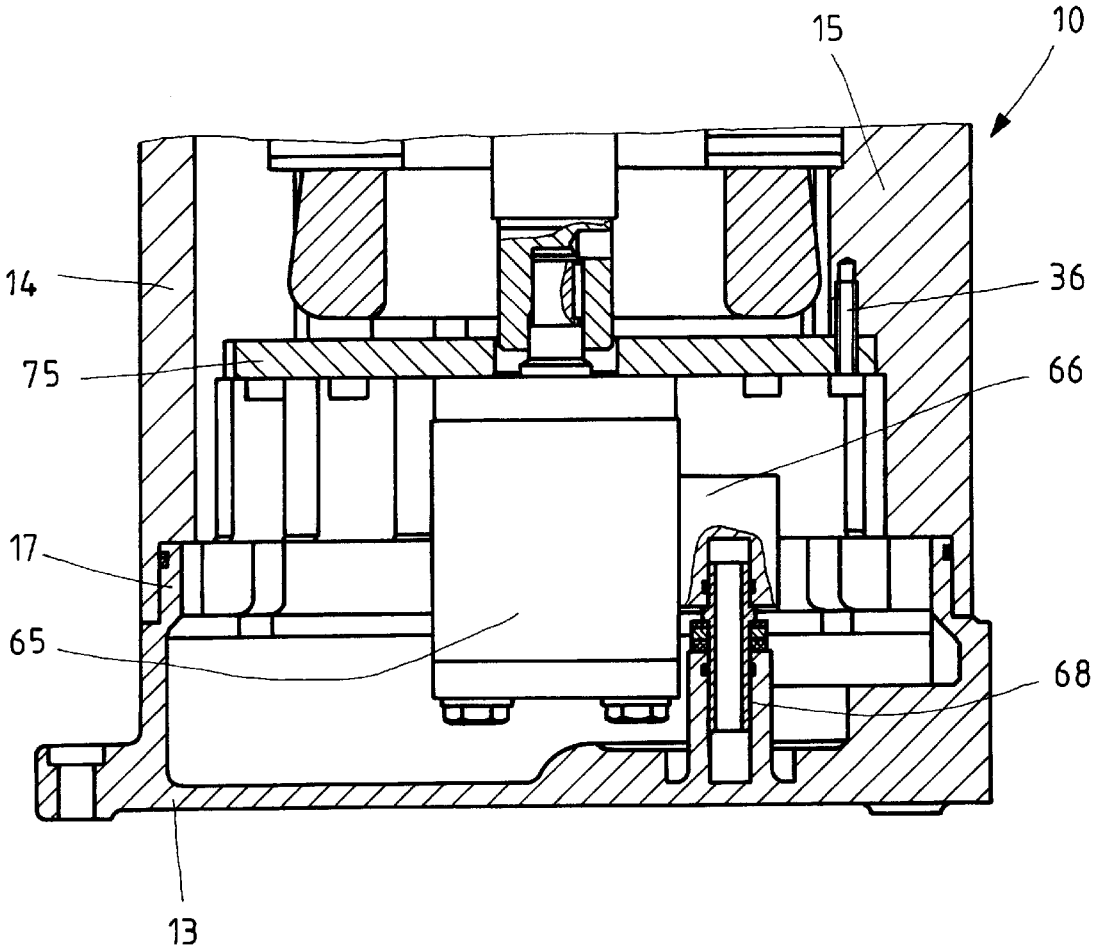
Figure 7:
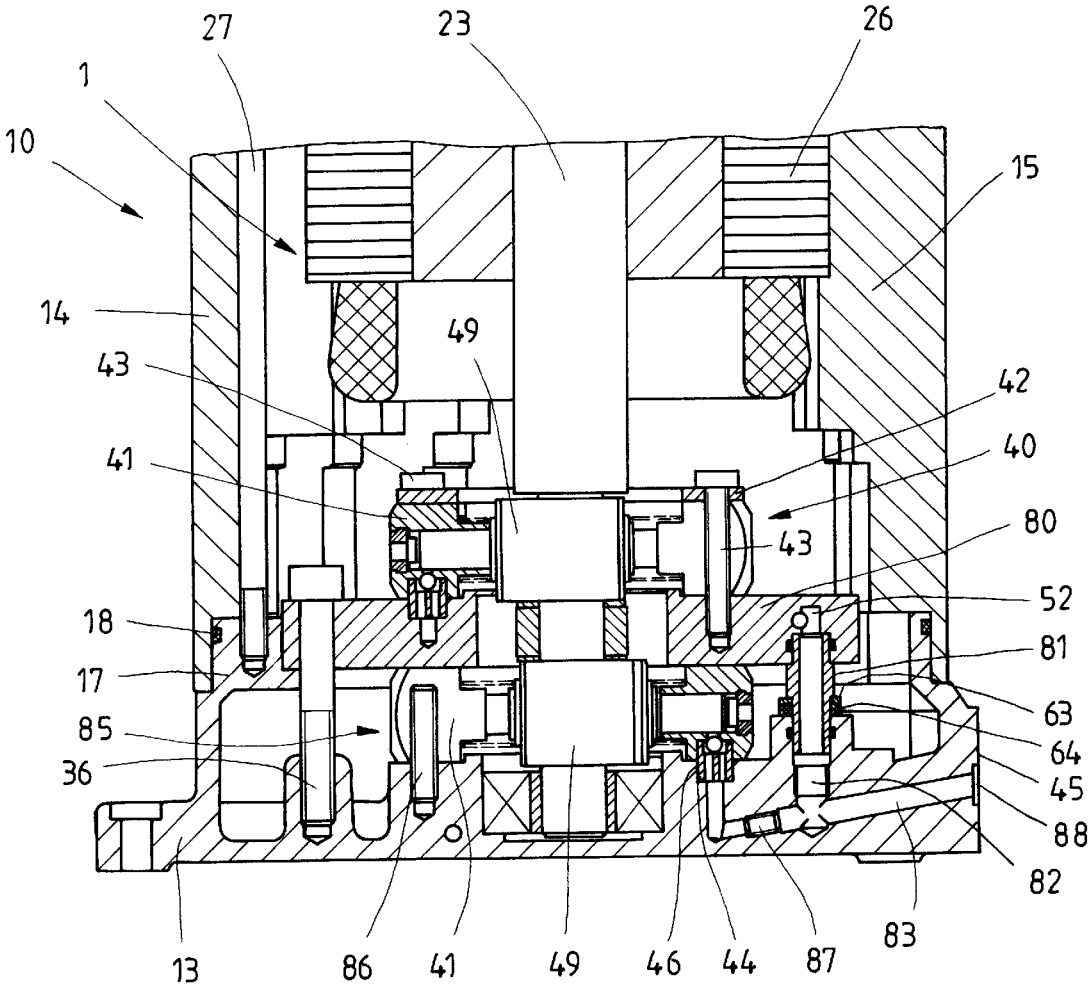
Figure 8:
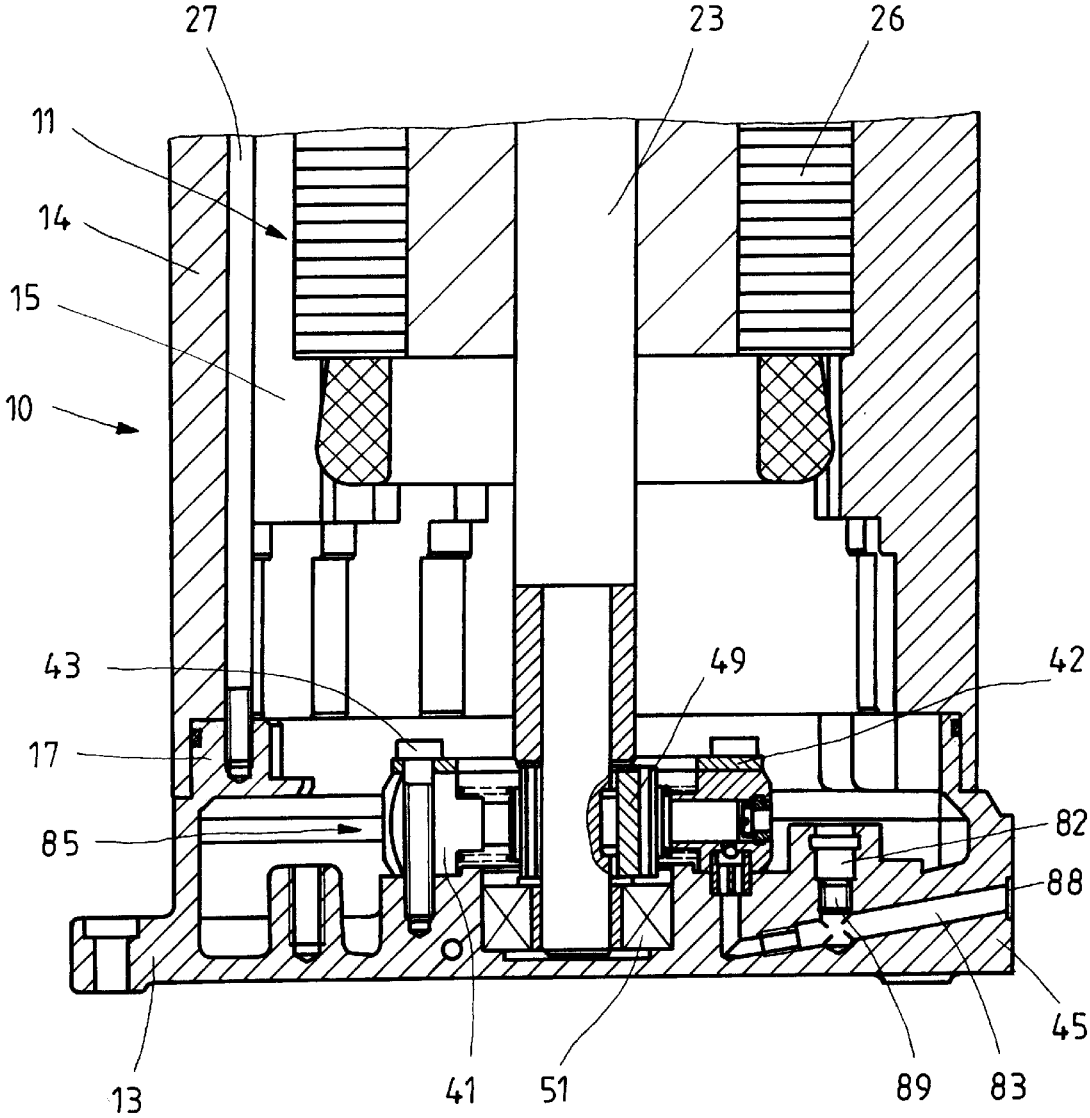

In the drawings:

FIG. 1 shows a longitudinal section through the first example of embodiment, wherein a plurality of conveying units of a radial piston pump are fixed on the side of the support plate facing the electric motor and a gear pump is fixed on the side of the support plate remote from the electric motor, an axially plugged-in tube lying in the pressurized flow path of each pump;

FIG. 2 shows a longitudinal section through part of the unit according to FIG. 1, the section extending in a different plane;

FIG. 3 shows an alternative embodiment of the unit according to FIGS. 1 and 2, in which the delivery connections for the two pumps are exchanged by comparison with the embodiment shown in FIGS. 1 and 2;

FIG. 4 shows a plan view of the unit according to FIGS. 1 and 2, or the unit according to FIG. 3, in which the positions of the two existing delivery connections become clear;

FIG. 5 shows a longitudinal section through a second example of embodiment, wherein two gear pumps are disposed on the side of the support plate remote from the electric motor;

FIG. 6 shows a third example of embodiment, wherein a single gear pump is disposed on the side of the support plate remote from the electric motor;

FIG. 7 shows a fourth example of embodiment with the conveying units of a first radial piston pump on the side of the support plate facing toward the electric motor and with the conveying units of a second radial piston pump between the support plate and one housing cover; and FIG. 8 shows a compact electrohydraulic motor pump unit without a support plate in the interior of the housing, in which a plurality of conveying units of one radial piston pump are fixed on a housing cover, the latter being provided with an axial plug-in connection in order to enable it to be used, without substantial further modification, with motor pump units in accordance with embodiments 1 to 7.

DETAILED DESCRIPTION OF THE PREFERRED EMBODIMENT

The electrohydraulic motor pump units shown comprise a housing 10 which, first, fulfills the function of the reservoir for a pressurized fluid used for working and, in addition, may also be regarded as a housing of an electric motor 11. This housing comprises, as essential parts, a first housing cover 12, a second housing cover 13 and a housing mid-section 14. This is a section cut from a profiled tube produced from an aluminum alloy and has been subjected to final machining. Retaining webs 15 run axially along the inside of the housing mid-section 14 and, over a certain distance, have been entirely removed or, in some cases, removed at various heights from the end face of the housing mid-section 14. The housing cover, 12 or 13, is centered by means of a centering collar 17 in a turned recess 16 in each end face of the housing mid-section 14, in which the retaining webs 15 have been completely removed. A groove runs around the centering collar, in which groove a gasket 18 is received, by means of which the gap separating a cover from the housing mid-section is sealed. Overall, therefore, there are only two such sealing points present, with large diameters.

The housing cover 12 is fixedly connected to the housing mid-section 14 by means of individual small screws 19, which are driven radially through the housing mid-section 14 into the centering collar 17. A filling connector 20 for the pressurized fluid and a terminal box 21 for the electrical connection of the connections of the electric motor and an electric fan with a connecting cable, if present, are provided on the cover 12. In addition, the drive shaft 23 of the electric motor 11 is rotatably mounted via a ballbearing 22 in the cover 12. The stator 26 of the electric motor 11 is pressed into the housing mid-section.

The second housing cover 13 is retained on the housing mid-section 14 via long tie-rods 27, which extend axially between the retaining webs 15 and are screwed into inward-projecting eyelets of the centering collar 17 of the cover 13. The tie-rods extend from the housing cover 13 to beyond the electric motor 11 and pass, in individual bores, though an annular disk 28 which is laid on shoulders of the retaining webs at a short distance from the first housing cover 12. A nut 29 is screwed onto the end of each tie-rod 27, projecting in the direction of the cover 12 beyond the annular disk 28 and provided with a thread, and tightened against the annular disk 28.

In the motor pump units shown in FIGS. 1 to 7, a support plate 35, 75 or 80, which rests on shoulders of the retaining webs 15 produced by partial cutting-away is located between the cover 13 and the electric motor 11, entirely within the housing 10. The support plate is pressed onto the shoulders of the retaining webs 15 and held stationary in the housing 10 by a number of machine screws 36 which pass through it from the side of the cover 13 and are driven into threaded bores 37 in the retaining webs 15.

In the embodiment shown in FIGS. 1 to 4, a plurality of conveying units 41 of a radial piston pump 40 are fixed on the side of the support plate 35 facing toward the electric motor 11. Specifically, the conveying units are axially located between the support plate 35 and an annular disk 42, which is fixedly connected to the support plate 35 via screws 43 passing laterally by the conveying units 41 and guiding the conveying units laterally. The conveying units aspirate pressurized liquid from the interior of the housing 10 and release it via pressure valves 44 into a ducting system of the support plate 45 which lies in a flow path to one of two connecting sockets 45 on the cover 13. It is apparent from FIG. 4 that the two connecting sockets 45 are disposed at an angular distance of 90° apart on the cover 13. The pressure valves 44 substantially consist of, in each case, a spherical closing body, a closing spring and a cylindrical housing which plugs at one end into the support plate 35 and at the other end into the cylinder of a conveying unit 41 and thus helps to mount the conveying units 41. The pistons 47 of the conveying units 41 are pressed by a spring 48 against a cam 49 of a camshaft 50, which is inserted into the motor shaft 23 and is rotatably mounted in a ballbearing 51 received by the support plate 35.

The outlets of the pressure valves 44 are connected to one another via ducts substantially extending in a radial plane of the support plate 35. An axial bore 52, which starts from the side of the support plate 35 remote from the conveying units 41, is provided with a thread on a narrower inner section and comprises an annular groove 53 for receiving a gasket 54 in an outer, wider section, opens into these ducts at each of two points therein. One of the two axial bores 52 is closed off by a screw 55. A straight and axially extending tube 60 is plugged into the other axial bore 52 by an externally machined end section. This tube lies in the flow path which leads from the pressure valves 44 of the conveying units 41 to one of the two connecting sockets 45 on the cover 13. This flow path is sealed off from the interior of the housing 10 at the transition from the support plate 35 to the tube 60 by a gasket 54 lying in the groove 53. The tube 60 bridges the distance between the support plate 35 and the cover 13, which comprises a bore 61 which is axially aligned with a bore 52 of the support plate 35 and into which the tube 60 is plugged axially by its second end section, which is likewise machined. The distance between the two axial shoulders, formed by the machining operations at the two ends, of the tube 60 is less than the clear distance between the support plate 35 and the cover 13. This is arranged in this way in order for it to be possible to push one or more compensating disks 62, a shim 63 and an O-ring 64 onto one end section of the tube, the O-ring 64 being seated with prestress on the tube and holding the compensating disks 62 and the shim 63 between itself and one axial stop of the tube. The O-ring 64 is used as a spring element which presses the tube 60, via the compensating disks 62 and the shim 63 by means of the axial stop on the other end section against the support plate 35. In this manner, tolerances relating to the clear distance between the support plate 35 and the cover 13 are compensated. In addition, the same tube 60 can be used for different embodiments, differences in the clear distance being compensated for by the use of different numbers and/or thicknesses of compensating disks and/or shins.

On the side of the support plate 35 remote from the electric motor 11 is fixed a gear pump 65, which comprises, externally on its jacket surface, a delivery connection onto which a connecting flange 66 is screwed. The latter possesses an insertion bore 67, which extends axially, opening toward the cover 13, and is in connection with the delivery connection of the gear pump 65 through out-of-true bores within the connecting flange 66. The cover 13 possesses, axially aligned with the bore 67, a second insertion bore 61 which is in connection via ducts in the cover 13 with the delivery aperture in the second connecting cap of the cover 13. Between the second insertion bore 61 and the insertion bore 67 in the connecting flange 66 extends a tube 68 which, like the tube 60, is straight and extends axially, possesses machined end sections, is pressed like the tube 60 by an O-ring 64, compensating disks 62 and a shim 63 by means of an axial shoulder against the connecting flange 66, and is plugged into the insertion bores in a sealing manner.

When a drive is provided by the electric motor 11, in the example of embodiment shown in FIGS. 1 and 2, the conveying units 41 of the radial piston pump convey pressure medium via the pressure valves 44, the ducting system in the support plate 35, the tube 60 and a duct formed by one or more bores in the cover 13 to a connecting cap 45, which may be referred to as the first connecting cap. The gear pump 65 pumps via the connecting flange 66, the tube 68 and a duct in the cover 13 to the second connecting flange 45. With the compact unit, therefore, hydraulic consumers lying in two separate hydraulic circuits can be supplied with pressure medium. It may sometimes be desirable here, with the same arrangement of the unit on a machine, for the radial piston pump to pump to the second connecting cap and the gear pump to the first connecting cap. In order for it to be possible to provide the kind of alternative embodiment shown in FIG. 3 in an easy manner, simply by means of a different assembly of the parts, the second insertion bore 52 is present in the support plate 35. The insertion bore 52 closed off by the screw 55 in the embodiment shown in FIGS. 1 and 2 is in fact precisely aligned with the second insertion bore 61 of the cover 13. The long tube 60 can thus readily be plugged into the second insertion bore of the support plate 35 and the second insertion bore 61 of the cover 13. In that case, the other insertion bore 52 of the support plate 35 is closed off by a screw 55. For the flow path between the gear pump 65 and the other connecting cap on the cover 13, a connecting flange 66 is used in which the insertion bore 67 lies on the other side from the delivery connection of the gear pump 65, as is clearly apparent from FIG. 3. Apart from the two different connecting flanges 66, therefore, no different parts are necessary in order to produce the two alternative embodiments, either that according to FIGS. 1 and 2 or that according to FIG. 3.

In the embodiment shown in FIG. 5, two gear pumps 65 are driven via the drive shaft 23 of the electric motor 11, these being arranged axially in series and fixed on a support plate 75 which, in exactly the same way as the support plate 35 of the embodiment according to FIG. 1, is fixed on the housing mid-section 14. The support plate 75 is thinner in the axial direction than the support plate 35, as it comprises neither ducts for the pressure medium flow nor a seating for a bearing. The two covers 12 and 13, of which only the cover 13 is shown in FIG. 5, are the same as in the first example of embodiment. The housing mid-section may have a different length from that in the first example of embodiment. The flow path from the delivery connection of the gear pump 65 nearer to the cover 13 to the second connecting cap 45 of the cover 13 is identical to the corresponding flow path of the gear pump 65 of the first example of embodiment. Again, the short tube 68 lies within it and is plugged axially into an insertion bore 67 of a connecting flange 66 and into the second insertion bore 61 of the cap 13. The connecting flange 66, which has also been used for the version of the first example of embodiment shown in FIG. 3, is fixed to the delivery connection of the gear pump 65 seated directly on the support plate 75. In the case of this connecting flange, the insertion bore 67 open toward the cover 13 lies on the other side of the delivery connection of the gear pump. Between the connecting flange and the first insertion bore 61 of the cover 13 extends a long, straight tube 60 which, exactly as in the first embodiment, is machined at its ends and is pressed against the connecting flange 66 by an O-ring 64 with interposed compensating disks 62 and shim 63. In operation, therefore, one gear pump 65 pumps to the first connecting cap and the other gear pump 65 to the second connecting cap 45 of the cover 13.

The example of embodiment shown in FIG. 6 differs from that shown in FIG. 5 primarily in that it comprises not two gear pumps 65 but only one. Accordingly, the housing mid-section 14 of the embodiment according to FIG. 6 is shorter than in the embodiment according to FIG. 5. The support plate is the same as in the embodiment according to FIG. 5 and, as in that case and as in the embodiment according to FIG. 1, is fixed to the housing mid-section 14 by screws 36. The gear pump 65 pumps via a connecting flange 66, a short, axially extending and plugged-in tube 68 and ducts in the cover 13 to the first or second connecting cap 45, depending on which connecting flange 66 is used. A closure screw is screwed into the delivery aperture of the other connecting cap.

In the embodiment according to FIG. 7, again, a thicker support plate 80 is present than in the two embodiments according to FIGS. 5 and 6, in which support plate 80 a ducting system for a pressure medium flow is provided. On the side of the support plate 80 facing the electric motor 11, as in the embodiment according to FIG. 1, conveying units 41 of a radial piston pump 40 are retained with the aid of an annular disk 42 and with the aid of screws 43. A single axial insertion bore 52 opens into the ducting system of the support plate 80, into which insertion bore 52 is plugged a tube 81, extending axially and machined at both its ends, and having, by comparison with the tubes 60, a short clear distance to bridge between the support plate 80 and the cover 13. The axial insertion bore 82 present in the cap 13 for the tube 81 is provided with a thread within a section located upstream of the end face of the tube 81 and opens into a bore 83 tilted slightly out of the plane of the cover 13 and leading to one of two connecting sockets 45. The tube 81, also, is pressed against the support plate 80 by an O-ring 64 with the interposition of a shim 63.

The support plate 80 in the example of embodiment according to FIG. 7 is retained not on the housing mid-section 14 but, with the interposition of a plurality of conveying units 41 of a second radial piston pump 85, on the cover 13 by means of machine screws 36. The conveying units 41 are clamped between the cover 13 and the support plate 80. In addition, they are secured by threaded bolts 86 driven into the cover 13 and guiding them laterally. Furthermore, of course, the housings 46 of the pressure valves 44 of the conveying units 41 of the second radial piston pump 85 also contribute to the mounting of the conveying units. The conveying units of the second radial piston pump 85 convey pressure medium into a ducting system of the cover 13, which comprises a bore (not shown in detail) which leads to the second connecting cap 45 (likewise not shown in detail). The bore 83 apparent from FIG. 7 also opens into the ducting system of the second radial piston pump 85 at a distance from the axial bore 82. As is apparent from FIG. 7, however, a closure screw 87 is driven into the section of the bore 83 which is located between the axial bore 82 and the ducting system of the radial piston pump 85, so that separate pressurized flow paths are present for the two radial piston pumps 40 and 85, the radial piston pump 40 pumping to the connecting cap 45 identifiable in FIG. 7 and the radial piston pump 85 to the other connecting cap 45. In an alternative version of the embodiment according to FIG. 7, the screw 87 may be absent and the delivery aperture of the second connecting cap 45 closed off. In this case, both radial piston pumps pump to the connecting cap 45 visible in FIG. 7.

In the compact unit shown in FIG. 8, a plurality of conveying units 41 of a radial piston pump 85 are fixed on the cover 13 by means of an annular disk 42 and by means of screws 43. A support plate, located entirely within the housing, for a pump or for individual conveying units of a pump is not present. The cover 13 is identical with the cover of the embodiment according to FIG. 7. However, a closure screw 89 is driven into the threaded section of the axial insertion bore 82, whereas the closure screw 87 is absent. The conveying units 41 thus pump via the bore 83 to the delivery aperture 88 of one connecting cap 45. The closure screw 89 prevents a short circuit within the housing 10. The unit according to FIG. 8 thus again expresses the inventive idea of providing, irrespective of the actual specification of a hydraulic compact unit, the delivery connection for the one or more pumps in the cover 13 in each case.

It should also be pointed out that, in the two embodiments according to FIGS. 7 and 8, a long motor shaft 23 is mounted in a roller bearing 51 received by the cover 13. Each cam 49 is shrunk onto the motor shaft 23.

I claim:

1. A compact electrohydraulic motor pump unit comprising a housing (10) which forms a reservoir for a pressurized fluid and contains an electric motor (11), and which comprises a first housing sealing section (12), a second housing sealing section (13) and a tubular housing mid-section (14) therebetween, with a support plate (35, 75, 80) disposed between the second housing sealing section (13) and the electric motor (11) in the housing (10) and with a pump (40, 65, 85) located within the housing (10) and drivable by the electric motor (11) via a motor shaft (23), which pump is fixed on the support plate (35, 75, 80) and can convey pressurized fluid in a pressurized flow path to a delivery connection (88), wherein the delivery connection (88) is located externally on the second housing sealing section (13), the second housing sealing section (13) and the tubular housing mid-section (14), sealing an interior of the housing (10) from the outside, lie against one another peripherally and the support plate (35, 75, 80) is located entirely in the interior of the housing (10), and wherein a tube (60, 68, 81) lies in the pressurized flow path and is connected axially plugged-in with the second housing sealing section (13) at one end and connected axially plugged-in with a counterpart (35, 66, 75, 80) at the other end.

2. The compact electrohydraulic motor pump unit as claimed in claim 1, wherein the tube (60, 68, 81) is straight and extends axially.

3. The compact electrohydraulic motor pump unit as claimed in claim 1, wherein the tube (60, 68, 81) is plugged into a bore in the counterpart (35, 66, 75, 80) or in the second housing sealing section (13).

4. The compact electrohydraulic motor pump unit as claimed in claim 1, wherein the tube (60, 68, 81) is pressed against the other section (35, 66, 75, 80) in one axial direction by a spring element (64), which is tensioned between the tube (60, 68, 81) and one section (13) of the two sections comprising the counterpart (35, 66, 75, 80) and the second housing sealing section (13).

5. The compact electrohydraulic motor pump unit as claimed in claim 4, wherein the tube (60, 68, 81) is turned down at one end and comprises an external shoulder and the spring element (64) is tensioned between the external shoulder of the tube (60, 68, 81) and the counterpart or the second housing sealing section (13).

6. The compact electrohydraulic motor pump unit as claimed in claim 5, wherein the spring element (64) is an O-ring.

7. The compact electrohydraulic motor pump unit as claimed in 5, wherein the spring element (64) is supported via a shim (63) on the tube (60, 68, 81).

8. The compact electrohydraulic motor pump unit as claimed claim 5, further comprising by length compensation disk (62) lying in front of an external shoulder of the tube (60, 68, 81).

9. The compact electrohydraulic motor pump unit as claimed in claim 6, further comprising a length compensation disk (62) lying in front of an external shoulder of the tube (60, 68, 81), and wherein the length compensation disk (62) lies between the O-ring (64) and the external shoulder of the tube (60, 68, 81).

10. The compact electrohydraulic motor pump unit as claimed in claim 1, wherein said tube (60, 81) extends between the support plate (35, 80) and the second housing sealing section (13).

11. The compact electrohydraulic motor pump unit as claimed in claim 1, wherein said tube (68) extends between a connecting flange (66) of a pump (65) and the second housing sealing section (13).

12. The compact electrohydraulic motor pump unit as claimed in claim 1, wherein the second housing sealing section (13) comprises two of said delivery connections (88) and two plug-in connections (61) for tube (60, 68), of which, optionally, only one or both is or are used.

13. The compact electrohydraulic motor pump unit as claimed in claim 12, wherein the support plate (35) comprises two plug-in connections (52) for tube (60), wherein the tube (60) extends between one plug-in connection (52) of the support plate (35) and one plug-in connection (61) of the second housing sealing part (13) and wherein the other plug-in connection (52) of the support plate (35) is closed off.

14. The compact electrohydraulic motor pump unit as claimed in claim 1, wherein a first pump (40) is disposed on a side of the support plate (35) remote from the second housing sealing part (13) and a pressurized flow path of said pump (40) leads through the support plate (35) and a plugged-in tube (60) extending between the latter and the second housing sealing part (13) to a first delivery connection (88) of the second housing sealing part (13), wherein a second pump (65) is disposed on a side of the support plate (35) facing toward the second housing sealing part (13), and a pressurized flow path of this second pump (65) leads through a connection flange (66) fixed thereto and a plugged-in tube (68) extending between the latter and the second housing sealing part (13) to a second delivery connection (88) of the second housing sealing part (13).

15. The compact electrohydraulic motor pump unit as claimed in claim 1, wherein a first pump (40) is disposed on a side of the support plate (35, 80) remote from the second housing sealing part (13) and a pressurized flow path of said first pump (40) leads through the support plate (35, 80), a plugged-in tube (60, 81) extending between said support plate (35, 80) and the second housing sealing section (13) and through the second housing sealing section (13), wherein a second pump (65, 85) is disposed on a side of the support plate (35, 80) facing toward the second housing sealing section (13), from which a pressurized flow path likewise leads into the second housing sealing section (13), wherein the second housing sealing section (13) has two said delivery connections (88) and the two last-mentioed pressurized flow paths are guidable, by appropriate installation of at least one closure screw (87) in the second housing sealing section (13), optionally either separately to the two delivery connections (88) or jointly to one of the two delivery connections (88) of the second housing sealing part (13).

16. The compact electrohydraulic motor pump unit as claimed in claim 15, wherein a bore (83) lying in one pressurized flow path leads away from each of said delivery connections (88) of the second housing sealing part (13), said bore (83) intersects the two pressurized flow paths, spaced apart from one another in axial direction of the bore (83), one said closure screw (87) being inserted, when the pressurized flow paths are guided separately to the two delivery connections (88), into a section of the latter bore (83) located between the two pressurized flow paths, whereas when the pressurized flow paths are jointly guided to only one of said delivery connections (88) a closure screw is inserted into one of the two bores between the confluence of the two pressurized flow paths and the corresponding delivery connection (88).

17. Compact electrohydraulic motor pump unit comprising a housing (10) which forms a reservoir for a pressurized fluid and contains an electric motor (11), and which comprises a first housing sealing section (12), a second housing sealing section (13) and a tubular housing mid-section (14) therebetween, with a pump (85) located within the housing (10) and drivable by the electric motor (11) via a motor shaft (23), which pump is fixed on the second housing sealing section (13) and can convey pressurized fluid in a pressurized flow path to a delivery connection (88) externally on the second housing sealing section (13), wherein an axial insertion bore (82) into which a closure screw (89) is driven, is located in the second housing sealing section (13), the axial insertion bore being a section of a pressurized fluid passage.

* * * * *